US006509129B2

(12) United States Patent
Eida et al.

(10) Patent No.: US 6,509,129 B2
(45) Date of Patent: Jan. 21, 2003

(54) TONER FOR ELECTROPHOTOGRAPHY

(75) Inventors: Akihiro Eida, Wakayama (JP); Hiroyuki Kawaji, Wakayama (JP)

(73) Assignee: KAO Corporation, Tokyo (JP)

( * ) Notice: Subject to any disclaimer, the term of this patent is extended or adjusted under 35 U.S.C. 154(b) by 0 days.

(21) Appl. No.: 09/954,055

(22) Filed: Sep. 18, 2001

(65) Prior Publication Data

US 2002/0058192 A1 May 16, 2002

(30) Foreign Application Priority Data

Sep. 18, 2000 (JP) ..... 2000-282585

(51) Int. Cl.[7] ..... G03G 9/087

(52) U.S. Cl. ..... 430/108.8; 430/109.4; 430/111.4; 430/124

(58) Field of Search ..... 430/108.8, 109.3, 430/111.4, 109.4, 124

(56) References Cited

U.S. PATENT DOCUMENTS 5,958,642 A * 9/1999 Takagi et al. ..... 430/110
6,063,536 A * 5/2000 Ikeyama et al. ..... 430/110
6,238,835 B1 * 5/2001 Tavernier et al. ..... 430/109

FOREIGN PATENT DOCUMENTS

| | | |
|---|---|---|
| EP | 0 807 858 A1 | 11/1997 |
| JP | A-5-188644 | 7/1993 |
| JP | A-10-312080 | 11/1998 |
| JP | A-11-352720 | 12/1999 |

* cited by examiner

*Primary Examiner*—John Goodrow
(74) *Attorney, Agent, or Firm*—Birch, Stewart, Kolasch & Birch, LLP

(57) ABSTRACT

A toner for electrophotography comprising Resin (A) and Resin (B), wherein Resin (A) comprises Resin (C) and a wax dispersed therein, wherein a difference between the softening point of Resin (C) and the melting point of the wax is within 20° C., and the softening point of Resin (B) is higher than the softening point of Resin (C), which can be used for developing electrostatic latent images formed in electrophotography, electrostatic recording method, electrostatic printing, toner jetting and the like.

13 Claims, No Drawings

TONER FOR ELECTROPHOTOGRAPHY

BACKGROUND OF THE INVENTION

1. Field of the Invention

The present invention relates to a toner for electrophotography used for developing electrostatic latent images formed in electrophotography, electrostatic recording method, electrostatic printing, toner jetting and the like.

2. Discussion of the Related Art

In order to improve the offset resistance in the toner, a wax is usually added together with a resin binder, a colorant and the like during the kneading process. However, when the wax is poorly dispersed in a resin binder, the durability is deteriorated such that there arise filming of the toner on a photoconductor, heat-fusion of a toner to a carrier in a two-component development, or heat-fusion of a toner to a charged blade in a one-component development. In order to eliminate the problems mentioned above, there has been proposed a process for preparing a toner comprising previously pre-dispersing a wax in a resin binder with applying a high shearing force and kneading the resulting dispersion together with the same resin and a pigment (Japanese Patent Laid-Open No. Hei 5-188644).

However, even in this process, since the resin for pre-dispersing the wax and the resin for diluting the dispersed wax-containing resin have similar thermal properties, shearing force is insufficient during the kneading of a toner, so that the wax cannot be sufficiently finely dispersed. In addition, as another process for preparing toner, there has been proposed a process comprising dispersing a wax in a resin binder during the polymerization of the resin binder (Japanese Patent Laid-Open Nos. Hei 9-304966, Hei 10-312080 and Hei 11-352720, and the like). However, since only a single component of a wax-containing resin as a resin binder is subjected to kneading, the shearing force is insufficient so that the wax cannot be sufficiently finely dispersed.

An object of the present invention is to provide a toner for electrophotography with a well-dispersed wax, the toner having excellent offset resistance and durability.

These and other objects of the present invention will be apparent from the following description.

SUMMARY OF THE INVENTION

According to the present invention, there is provided a toner for electrophotography comprising a toner for electrophotography comprising Resin is (A) and Resin (B), wherein Resin (A) comprises Resin (C) and a wax dispersed therein, wherein a difference between the softening point of Resin (C) and the melting point of the wax is within 20° C., and the softening point of Resin (B) is higher than the softening point of Resin (C).

DETAILED DESCRIPTION OF THE INVENTION

The toner of the present invention is a toner for electrophotography comprising Resin (A) and Resin (B) as the resin binders, wherein Resin (A) comprises Resin (C) and a wax dispersed therein, the wax having similar thermal properties to those of Resin (C). Therefore, the wax can be finely and homogeneously pre-dispersed in Resin (C) in a high concentration. Further, since Resin (B) having a higher softening point than that of Resin (C) is added and kneaded, kneading can be carried out under a high-shearing force, so that the dispersed state of the wax can be maintained or further improved.

Resin (C) includes, for instance, polyesters, epoxy resins, styrene-acrylate copolymers, polyurethanes, hybrid resins, and composite resins thereof In the present invention, a hybrid resin in which a condensation polymerization resin unit is chemically bonded with an addition polymerization resin unit is preferred. More preferred is a hybrid resin prepared by the steps comprising (a) preparing a mixture of raw material monomers for two polymerization resins each having an independent reaction path, i.e., a mixture of a raw material monomer for a condensation polymerization resin and a raw material monomer for an addition polymerization resin and, if necessary, a compound (dually reactive compound) capable of reacting with both of the raw material monomers for the two polymerization resins; and (b) carrying out the two polymerization reactions preferably in the same reaction vessel by the use of the mixture obtained in step (a).

Representative examples of the condensation polymerization resin include polyesters, polyester-polyamides, polyamides, and the like. Representative examples of the addition polymerization resin include vinyl resins obtained by radical polymerization, and other resins.

The raw material monomer for the polyester includes dihydric or higher polyhydric alcohols and dicarboxylic acid or higher polycarboxylic acid compounds.

The dihydric alcohol includes, for instance, alkylene oxide adducts of bisphenol A such as polyoxypropylene (2.2)-2,2-bis(4-hydroxyphenyl)propane and polyoxyethylene(2.0)-2,2-bis(4-hydroxyphenyl)propane, ethylene glycol, 1,2-propylene glycol, 1,4-butanediol, neopentyl glycol, polyethylene glycol, polypropylene glycol, bisphenol A, hydrogenated bisphenol A, and the like, The trihydric or higher polyhydric alcohol includes, for instance, sorbitol, pentaerythritol, glycerol, trimethylolpropane, and the like.

In the present invention, these dihydric or higher polyhydric alcohols can be used alone or in admixture of two or more kinds.

In addition, the dicarboxylic acid compound includes, for instance, dicarboxylic acids such as maleic acid, fumaric acid, phthalic acid, isophthalic acid, terephthalic acid and succinic acid; a substituted succinic acid of which substituent is an alkyl group having 1 to 20 carbon atoms or an alkenyl group having 2 to 20 carbon atoms, such as n-dodecenylsuccinic acid, isododecenylsuccinic acid, n-dodecylsuccinic acid, isooctenylsuccinic acid and isooctylsuccinic acid; acid anhydrides thereof or lower alkyl(1 to 3 carbon atoms) esters thereof; and the like. Among them, maleic acid, fumaric acid, terephthalic acid and a substituted succinic acid of which substituent is an alkenyl group having 2 to 20 carbon atoms are preferably used.

The tricarboxylic or higher polycarboxylic acid compound includes, for instance, 1,2,4-benzenetricarboxylic acid, 2,5,7-naphthalenetricarboxylic acid, pyromellitic acid, acid anhydrides, lower alkyl(1 to 3 carbon atoms) esters thereof, and the like. Among them, 1,2,4-benzenetricarboxyhc acid, i.e., trimellitic acid, and the anhydride thereof are particularly preferably used since they are inexpensive and the reaction is easily controlled.

In the present invention, these dicarboxylic or higher polycarboxylic acid compounds can be used alone or in admixture of two or more kinds.

In the formation of the polyester, an esterification catalyst such as dibutyltin oxide can be appropriately used.

In addition, the raw material monomer for forming the amide component of the polyester-polyamide or the polyamide includes various known polyamines, aninocarboxylic acids and amino alcohols, and hexamethylenediamine and ϵ-caprolactam are preferred.

Incidentally, the above-described raw material monomer also includes those usually classified as a monomer for ring-opening polymerization. Since these monomers are hydrolyzed in the presence of water generated by the condensation reaction of other monomers and then subjected to condensation, the monomers are considered to be included in the raw material monomer for condensation polymerization resins in a broad sense.

The raw material monomer for the vinyl resin includes styrenic compounds such as styrene and a-methylstyrene; ethylenically unsaturated monoolefins such as ethylene and propylene; diolefins such as butadiene; vinyl halides such as vinyl chloride; vinyl esters such as vinyl acetate and vinyl propionate; esters of ethylenic monocarboxylic acids such as alkyl(1 to 18 carbon atoms) esters of (meth)acrylic acid, 2-hydroxyethyl (meth)acrylate, glycidyl (meth)acrylate, and dimethylaminoethyl (meth)acrylate; vinyl ethers such as vinyl methyl ether; vinylidene halides such as vinylidene chloride; N-vinyl compounds such as N-vinylpyrrolidone; and the like. It is desired that styrene and/or the alkyl ester of (meth)acrylic acid is contained in an amount of 50% by weight or more, preferably from 80 to 100% by weight of the raw material monomer for the vinyl resin.

When the raw material monomers for the vinyl resin are polymerized, a polymerization initiator, a crosslinking agent, or the like may be used, if necessary.

In the present invention, it is desired that the weight ratio of the condensation polymerization resin unit to the addition polymerization resin unit, i.e. the weight ratio of the raw material monomer for the condensation polymerization resin unit to the raw material monomer for the addition polymerization resin unit, is usually from 50/50 to 95/5, preferably from 60/40 to 95/5, because it is preferable that the continuous domain is the condensation polymerization resin. While the dually reactive compound itself can be used as a raw material monomer for any of the condensation polymerization resin and the addition polymerization resin in a single reaction system, the dually reactive compound is defined as a different monomer from the raw material monomer for the condensation polymerization resin and the raw material monomer for the addition polymerization resin, owing to the specificity of its performance. Therefore, the dually reactive compound is not included as any of monomers in the weight ratio of the raw material monomer for condensation polymerization to the raw material monomer for addition polymerization.

It is preferable that the dually reactive compound is a compound having at least one functional group selected from the group consisting of hydroxyl group, carboxyl group, epoxy group, a primary amino group and a secondary amino group, and an ethylenically unsaturated bond in the molecule. The dispersibility of the resin to be the dispersed phase can be improved by using the dually reactive compound described above. Concrete examples of the dually reactive compound include, for instance, acrylic acid, fumaric acid, methacrylic acid, citraconic acid, maleic acid, and the like. Among them, acrylic acid, methacrylic acid and fumaric acid are preferred.

The amount of the dually reactive compound used is preferably from 0.1 to 10 parts by weight based on 100 parts by weight of the raw material monomer for the condensation polymerization resin, and the amount of the dually reactive compound is preferably from 0.3 to 20 parts by weight, more preferably from 0.5 to 10 parts by weight based on 100 parts by weight of the raw material monomer for the addition polymerization resin.

In the present invention, the hybrid resin can be obtained by carrying out the two polymerization reactions using a mixture of the raw material monomers and preferably the dually reactive compound described above. Here, the polymerization reactions do not necessarily progress or terminate simultaneously, and each of the reactions may be progressed or terminated by appropriately selecting the reaction temperature and reaction time depending upon each of the reaction paths.

For instance, a preferred process for preparing the hybrid resin in the present invention comprises mixing a raw material monomer for a condensation polymerization resin, a raw material monomer for an addition polymerization resin, a dually reactive compound and a polymerization initiator with each other; mainly carrying out radical polymerization reaction at 50° to 180° C., to firstly give an addition polymerization resin component having a functional group reactive for a subsequent condensation polymerization reaction; raising the reaction temperature to 190° to 270° C.; and carrying out condensation polymerization reaction to mainly form a condensation polymerization resin component.

The softening point of Resin (C) is preferably from 60° to 150° C., more preferably from 70° to 140° C., still more preferably from 80° to 130° C. Incidentally, in the case where a wax is present in the polymerization step for Resin (C) as described below, the softening point of the resin is considered substantially not to be affected by the wax. Therefore, the softening point of the resulting resin, i.e., Resin (A) comprising Resin (C) and the wax dispersed therein, is considered to be the softening point of the Resin (C). In addition, the glass transition point of Resin (C) is preferably from 30° to 80° C., more preferably from 40° to 70° C., still more preferably from 40° to 65° C.

The wax includes polyolefin waxes such as polypropylene waxes, polyethylene waxes, and polypropylene-polyethylene copolymer waxes; ester waxes such as Fischer-Tropsch wax, carnauba wax, haze wax, beeswax, spermaceti wax, and montan wax; amide waxes such as fatty acid amide waxes; and the like. Among them the polyethylene waxes and Fischer-Tropsch wax are preferable, from the viewpoint of the offset resistance.

The melting point of the wax is preferably from 60° to 130° C., more preferably from 70° to 120° C., especially preferably from 75° to 110° C.

The content of the wax is preferably from 1 to 70 parts by weight, more preferably from 5 to 50 parts by weight, especially preferably from 10 to 40 parts by weight, based on 100 parts by weight of Resin (C) or the raw material monomer for Resin (C).

In the present invention, Resin (A) may be obtained by melt-kneading the wax with Resin (C), or alternatively, Resin (A) may be obtained by polymerizing raw material monomers of Resin (C) in the presence of the wax. Among them, the latter embodiment is preferred. Incidentally, as long as the wax is present even in a small amount at any time point of the polymerization step, a matching desired effect can be obtained. However, in the case where Resin (C) is a hybrid resin, it is desired that the wax is present preferably from the beginning of the polymerization step of the raw material monomer for the addition polymerization resin because the effect of homogeneously dispersing the wax in the resin can be even more improved.

Resin (B) includes polyesters, epoxy resins, styrene-acrylate copolymers, polyurethanes, hybrid resins, composite resins thereof, and the like. Among them, the polyesters are preferred from the viewpoint of the fixing strength. The polyester is prepared by carrying out condensation polymerization of a dihydric or higher polyhydric alcohol with a dicarboxylic acid or higher polycarboxylic acid compound. As the polyhydric alcohol and the polycarboxylic acid compound described above, the same compounds as those exemplified as the raw material monomer for the polyester in the hybrid resin can be used.

The condensation polymerization of the polyhydric alcohol with the polycarboxylic acid compound can be carried out by such a step of reacting the polyhydric alcohol with the polycarboxylic acid compound in an inert gas atmosphere at a temperature of 150° to 250° C., using, if necessary, an esterification catalyst, a polymerization inhibitor or the like.

It is desired that the polyester has an acid value of from 1 to 40 mg KOH/g, preferably from 6 to 35 mg KOH/g, a hydroxyl value of from 20 to 60 mg KOH/g, a softening point of from 80° to 155° C., and a glass transition point of from 50° to 70° C.

In the present invention, the difference between the softening point of Resin (C) and the melting point of the above-described wax is within 20° C., preferably within 15° C., more preferably within 10° C. The softening point of Resin (B) is higher than the softening point of Resin (C), wherein the difference between the softening point of Resin (B) and the softening point of Resin (C) is preferably greater than 5° C., more preferably greater than 10° C., especially preferably from 10° to 50° C. As described above, since the difference between the softening point of the resin and the melting point of the wax is adjusted within a given value and the difference between the softening points of the resins is adjusted to be greater than a given value, the wax can be finely and homogeneously pre-dispersed in Resin (C) in a high concentration. Therefore, when a toner is prepared by kneading the resulting wax-dispersed resin with Resin (B), the dispersed size of the wax is further reduced, so that the releasing property of the resulting toner is improved and the adhesion of the toner onto a photoconductor is suppressed, whereby a toner having excellent offset resistance and durability can be obtained.

The compositional weight ratio of Resin (A) to Resin (B) (Resin (A)/Resin (B)) is preferably from 3/97 to 70/30, more preferably from 5/95 to 50/50.

The resin binder for the toner for electrophotography of the present invention can appropriately contain, in addition to Resin (A) and resin (B), the polyester and the hybrid resin other than those defined in the present invention, a resin which is generally known as a resin binder for toner, such as a styrene-acrylic resin, an epoxy resin, a polycarbonate, a polyurethane or the like. Here, the total amount of the Resin (A) and Resin (B) in the resin binder is preferably from 50 to 100% by weight, more preferably from 80 to 100% by weight, especially preferably 100% by weight.

Further, the toner for electrophotography of the present invention can appropriately contain an additive such as a colorant, a charge control agent, a releasing agent, an electric conductivity modifier, an extender, a reinforcing filler such as a fibrous substance, an antioxidant, an anti-aging agent, a fluidity improver, and a cleanability improver.

As the colorant, all of the dyes and pigments which are used as colorants for a toner can be used, and the colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazoyellow, and the like. The toner of the present invention can be used as any of black toners, monochromatic toners, and full color toners. These colorants can be used alone or in admixture of two or more kinds. The content of the colorant is preferably from 1 to 60 parts by weight based on 100 parts by weight of the resin binder.

The toner of the present invention is preferably a pulverized toner obtained by a kneading-pulverization method, which is prepared by the step comprising melt-kneading at least Resin (A) with Resin (B). Concretely, the method comprises, for instance, homogeneously mixing a resin binder, a colorant, and the like in a mixer such as a ball-mill, thereafter melt-kneading with a closed kneader or a single-screw or twin-screw extruder, cooling, pulverizing and classifying the product. Further, a fluidity improver and the like may be added to the surface of the toner as occasion demands. The volume-average particle size of the toner thus obtained is preferably from 3 to 15 $\mu$m.

The toner for electrophotography of the present invention may be used alone as a developer, in a case where the particulate magnetic material is contained. Alternatively, in a case where the particulate magnetic material is not contained, the toner may be used as a nonmagnetic one-component developer, or the toner can be mixed with a carrier and used as a two-component developer.

EXAMPLES

[Softening Point]

The softening point refers to a temperature corresponding to ½ of the height (h) of the S-shaped curve showing the relationship between the downward movement of a plunger (flow length) of a flow tester and temperature, namely, a temperature at which a half of the resin flows out, when measured by using a flow tester of the "koka " type ("CFT-500D," manufactured by Shimadzu Corporation) in which a 1 g sample is extruded through a nozzle having a dice pore size of 1 mm and a length of 1 mm while heating the sample so as to raise the temperature at a rate of 6° C./min and applying a load of 1.96 MPa thereto with the plunger.

[Glass Transition Point of Resin and Melting Point of Wax]

The glass transition point of the resin refers to the temperature of an intersection of the extension of the base-line of not more than the endothermic temperature and the tangential line showing the maximum inclination between the kickoff of the peak and the top of curves when measuring with a sample using a differential scanning calorimeter (DSC 210, manufactured by Seiko Instruments, Inc.), when the sample is treated by raising its temperature to 200° C., allowing the sample to stand at the same temperature for 3 minutes, thereafter cooling the sample at a cooling rate of 10° C./min. to room temperature, and heating the sample so as to raise the temperature at a rate of 10° C./min. Also, the melting point of the wax refers to an exothermic peak temperature.

[Average Particle Size]

The average particle size refers to a median particle size in the volume distribution when measuring by a Coulter Multisizer I (manufactured by Beckmann Coulter, Inc.) using an aperture having a diameter of 100 $\mu$m.

Resin Preparation Example 1

A mixture of 2450 g of a 2.2 mol propylene oxide adduct of bisphenol A, 975 g of a 2.0 mol ethylene oxide adduct of bisphenol A, 812 g of terephthalic acid, 469 g of trimellitic acid anhydride, 655 g of an alkenylsuccinic acid, and 13 g of dibutyltin oxide as an esterification catalyst, was subjected to condensation polymerization at 230° C. with stirring under a nitrogen atmosphere, to give Resin a. The resulting resin had a softening point of 112° C. and a glass transition point of 60° C.

Resin Preparation Example 2

A 5-liter glass flask was charged with 1150 g of a 2.2 mol propylene oxide adduct of bisphenol A, 1304 g of a 2.0 mol ethylene oxide adduct of bisphenol A, 812 g of terephthalic acid, 134 g of trimellitic acid anhydride, and 8 g of dibutyltin oxide (esterification catalyst). With stirring the mixture in the flask at 160° C. under a nitrogen atmosphere, a mixture of 580 g of styrene, 230 g of 2-ethylhexyl acrylate, 29 g of acrylic acid (dually reactive compound) and 29 g of dibutyl peroxide (polymerization initiator) was added dropwise from a dropping funnel to the flask over a period of 1 hour. The addition polymerization reaction was matured for 2 hours, with keeping the mixture at 160° C., and thereafter the mixture was heated to 230° C. and subjected to condensation polymerization, to give Resin b. The resulting resin had a softening point of 89° C. and a glass transition point of 50° C.

Resin Preparation Examples 3 and 4

The same procedures as in Resin Preparation Example 2 were carried out except that the time periods for the condensation polymerization were adjusted, to give Resins c and d. Resin c had a softening point of 112° C. and a glass transition point of 61° C., and Resin d had a softening point of 131° C. and a glass transition point of 65° C.

Resin Preparation Examples 5 to 7

The same procedures as in Resin Preparation Example 1 were carried out except that the time periods for the condensation polymerization were adjusted, to give Resins e, f and g. Resin e had a softening point of 106° C. and a glass transition point of 60° C., Resin f had a softening point of 123° C. and a glass transition point of 62° C., and Resin g had a softening point of 138° C. and a glass transition point of 63° C.

Resin Preparation Example 8

The same procedures as in Resin Preparation Example 2 were carried out except that the flask was charged with 621 g of a polyethylene wax "SPLAY 105" (manufactured by Sazole, melting point: 105° C.) together with a 2.2 mol propylene oxide adduct of bisphenol A and the like, to give Resin h. The resulting resin had a softening point of 89° C. and a glass transition point of 48° C.

Resin Preparation Example 9

The same procedures as in Resin Preparation Example 4 were carried out except that the flask was charged with 621 g of Fischer-Tropsch wax (manufactured by Nippon Seiro Co., Ltd., melting point: 98° C.) together with a 2.2 mol propylene oxide adduct of bisphenol A and the like, to give Resin i. The resulting resin had a softening point of 131° C. and a glass transition point of 60° C.

Examples 1 and 2, and Comparative Examples 1, 2 and 4

Twenty parts by weight of Resin (C) and 3 parts by weight of the wax, as shown in Table 1, were kneaded with a twin-screw extruder heated at 120° C., and the kneaded mixture was roughly pulverized with a mechanical pulverizer to a degree that the pulverized mixture passed through a screen having an opening of 2 mm, to give Resin (A). The resulting Resin (A), and 80 parts by weight of Resin (B), 1 part by weight of a charge control agent and 3 parts by weight of a colorant, as shown in Table 1, were mixed together, and the mixture was kneaded with a twin-screw extruder heated at 170° C. The kneaded mixture was roughly pulverized, and thereafter finely pulverized with an air pulverizer-classifier so that the average particle size was adjusted to 9 $\mu$m, to give a powder. To 100 parts by weight of the resulting powder was added 0.3 parts by weight of a hydrophobic silica "Aerozil R-972" as an external additive, and the mixture was blended with a Henschel mixer, to give a toner. The state of wax dispersion in the resulting toner was evaluated by TEM observation of the cross section of the toner. The results are shown in Table 2.

Example 3 and Comparative Example 3

The same procedures as in Example 1 were carried out except that 23 parts by weight of Resin (A), 80 parts by weight of Resin (B), 1 part by weight of a charge control agent and 3 parts by weight of a colorant, as shown in Table 1, were mixed together. The results are shown in Table 2.

TABLE 1

| | Resin (A) | | | | |
|---|---|---|---|---|---|
| | Resin (C) | Wax[1)] | Resin (B) | Charge Control Agent[2)] | Colorant[3)] |
| Ex. 1 | Resin a | SPLAY 105 | Resin f | BONTRON E-84 | PB. 15:3 |
| Ex. 2 | Resin b | Fischer-Tropsch Wax | Resin f | T-77 | Mogul L |
| Ex. 3 | Resin h | | Resin a | BONTRON E-84 | P.Y. 17 |
| Comp. Ex. 1 | Resin c | SPLAY 105 | Resin a | BONTRON E-84 | P.B 15:3 |
| Comp. Ex. 2 | Resin a | SPLAY 105 | Resin e | BONTRON E-84 | P.Y. 17 |
| Comp. Ex. 3 | Resin i | | Resin g | T-77 | Mogul L |
| Comp. Ex. 4 | Resin d | SPLAY 105 | Resin f | BONTRON E-84 | P.R. 122 |

[1)]SPLAY 105: manufactured by Sazole, melting point: 105° C.
Fischer-Tropsch wax: manufactured by Nippon Seiro Co., Ltd., melting point: 98° C.
[2)]BONTRON E-84 (manufactured by Orient Chemical Co., Ltd.)
T-77 (manufactured by Hodogaya Chemical Co., Ltd.)

TABLE 1-continued

| Resin (A) | | | | |
|---|---|---|---|---|
| Resin (C) | Wax[1)] | Resin (B) | Charge Control Agent[2)] | Colorant[3)] |

[3)]P.Y. 17 (C.I. Pigment Yellow 17)
P.B. 15:3 (C.I. Pigment Blue 15:3)
Mogul L (carbon black)
P.R. 122 (C.i. Pigment Red 122)

Test Example 1

A toner was loaded in a color laser printer "COLOR PAGEPRESTO N4" (manufactured by CASIO COMPUTER CO., LTD.) comprising a nonmagnetic one-component developer system, and a solid image was printed. As a result, the offset was not observed for all of the toners, showing excellent fixing ability. Further, a 6500-sheet continuous printing was carried out at a printed ratio of 5%, and the durability was evaluated by visually determining whether or not a white line was generated on the image due to the thermal adhesion of toner on the blade. After the continuous printing, the toners which did not show generation of a white line were then tested for a solid image printing, and the homogeneity was visually evaluated. The durability was evaluated based on the evaluation of the uniformity together with generation of a white line. The results are shown in Table 2.

TABLE 2

| | Softening Point or Melting Point (° C.) | | | Dispersibility of Wax | Durability | |
|---|---|---|---|---|---|---|
| | Resin (A) | | | | Thermal Adhesion to Blade | Appearance |
| Nos. | Resin (C) | Wax | Resin (B) | (Dispersed Particle Size) | (Generation of White Line) | of Solid Image |
| Ex. 1 | 112 | 105 | 123 | | | Blurred |
| Ex. 2 | 89 | 98 | 123 | Excellent (Maximally about 1 μm) | Not Generated | Slightly Blurred |
| Ex. 3 | 89 | 105 | 112 | | | Homogeneous Without Blur |
| Comp. Ex. 1 | 112 | 105 | 112 | Poor (Maximally about 3 μm) | Generated at 3000 sheets | Not Determined |
| Comp. Ex. 2 | 112 | 105 | 106 | | Generated at 2000 sheets | Not Determined |
| Comp. Ex. 3 | 131 | 98 | 138 | Slightly Poor (Maximally about 2 μm) | Generated at 3500 sheets | Not Determined |
| Comp. Ex. 4 | 131 | 105 | 123 | Poor (Maximally about 3 μm) | Generated for 2000 sheets | Not Determined |

As is clear from the above results, since all of the toners of Examples 1 to 3 contain a finely and homogeneously dispersed wax, the toners have excellent offset resistance and durability. Especially in Example 3 where the wax is present from the polymerization step for Resin (C), the toner has more excellent durability. On the contrary, in cases where the difference between the softening point of Resin (C) and the melting point of the wax exceeds 20° C., or cases where the softening point of Resin (C) is equal to or higher than the softening point of Resin (B), as in the toners of Comparative Examples 1 to 4, the dispersibility of the wax is decreased, so that the durability in continuous printing is insufficient.

According to the present invention, there can be provided a toner for electrophotography which contains a sufficiently and homogeneously dispersed wax, and has excellent offset resistance and durability.

What is claimed is:

1. A toner for electrophotography comprising Resin (A) and Resin (B), wherein Resin (A) comprises Resin (C) and a wax dispersed therein, wherein a difference between the softening point of Resin (C) and the melting point of the wax is within 20° C., and the softening point of Resin (B) is higher than the softening point of Resin (C), and wherein Resin (C) is a hybrid resin in which a condensation polymerization resin unit is chemically bonded to an addition polymerization resin unit.

2. The toner according to claim 1, wherein a difference between the softening point of Resin (B) and the softening point of Resin (C) is greater than 5° C.

3. The toner according to claim 1, wherein Resin (B) is a polyester.

4. The toner according to claim 1, wherein the melting point of the wax is from 60° to 130° C.

5. The toner according to claim 1, wherein a weight ratio of Resin (A) to Resin (B) is from 3/97 to 70/30.

6. The toner according to claim 1, wherein the wax is contained in an amount of from 1 to 70 parts by weight, based on 100 parts by weight of Resin (C).

7. The toner according to claim 1, wherein the wax is a polyethylene wax or Fischer-Tropsch wax.

8. The toner according to claim 3, wherein the hybrid resin is prepared by the steps comprising:

(a) preparing a mixture of a raw material monomer for a condensation polymerization resin and a raw material monomer for an addition polymerization resin; and (b) carrying out the two polymerization reactions by the use of the mixture obtained in step (a).

9. The toner according to claim 3, wherein the condensation polymerization resin is a polyester, and the addition polymerization resin is a vinyl resin.

10. The toner according to claim 3, wherein a weight ratio of the condensation polymerization resin unit to the addition polymerization resin unit is from 50/50 to 95/5.

11. The toner according to claim 1, wherein Resin (C) has a softening point of from 60° to 150° C.

12. The toner according to claim 1, wherein Resin (A) is obtained by polymerizing raw material monomers of Resin (C) in the presence of the wax.

13. The toner according to claim 1, wherein the toner is prepared by the step comprising melt-kneading Resin (A) with Resin (B).

* * * * *